US006736667B1

(12) United States Patent
Wu

(10) Patent No.: US 6,736,667 B1
(45) Date of Patent: May 18, 2004

(54) CABLE CONNECTOR ASSEMBLY HAVING PULL TAB

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/413,894

(22) Filed: Apr. 14, 2003

(51) Int. Cl.[7] ..... H01R 13/00
(52) U.S. Cl. ..... 439/484; 439/362
(58) Field of Search ..... 439/484, 362, 439/364, 365

(56) References Cited

U.S. PATENT DOCUMENTS 2,514,246 A * 7/1950 Knox ..... 361/727
4,881,911 A * 11/1989 Haddock et al. ..... 439/484
4,969,838 A * 11/1990 Himes et al. ..... 439/352
5,564,939 A 10/1996 Maitani et al.
5,788,534 A 8/1998 Koegel et al.
5,820,412 A 10/1998 Koegel et al.

* cited by examiner

*Primary Examiner*—Tulsidas Patel
*Assistant Examiner*—Phuong Dinh
(74) *Attorney, Agent, or Firm*—Wei Te Chung

(57) ABSTRACT

A cable connector assembly (1) includes a cover, an insulative housing (20), a number of contacts (22) retained in the insulative housing, a cable (7) electrically connected with the contacts, and a first and a second pull tabs (8). The cover includes a first and a second covers (3, 4) joined together to define a front end and a rear end opposite to the front end. The rear end defines a receiving space (46) therein. The insulative housing is situated at the front end of the cover. The first pull tab (81) includes a first engaging section (812), and the second pull tab (82) includes a second engaging section (822). The first engaging section engages with the second engaging section of the second pull tab and the engaged first and the second engaging sections are together received in the receiving space of the cover.

3 Claims, 8 Drawing Sheets

3

CABLE CONNECTOR ASSEMBLY HAVING PULL TAB

CROSS-REFERENCES TO RELATED APPLICATION

Relevant subject matter is disclosed in pending U.S. patent application Ser. Nos. 10/209,553 filed on Jul. 30, 2002 and entitled "ELECTRICAL CONNECTOR HAVING A LATCH MECHANISM", Ser. No. 10/210,129 filed on Jul. 31, 2002 and entitled "ELECTRICAL CONNECTOR HAVING A LATCH MECHANISM", Ser. No. 10/235,290 filed on Sep. 4, 2002 and entitled "ELECTRICAL CONNECTOR HAVING IMPROVED LATCH MECHANISM", Ser. No. 10/236,597 filed on Sep. 5, 2002 and entitled "ELECTICAL CONNECTOR HAVING ENGAGING DEVICE", Ser. No. 10/305,716 filed on Nov. 27, 2002 and entitled "ELECTRICAL CABLE CONNECTOR ASSEMBLY" and Ser. No. 10/387,902 filed on Mar. 12, 2003 and entitled "CABLE END CONNECTOR HAVING LOCKING MECHANISM", all of which are invented by the same inventor as this patent application and assigned to the same assignee with this application.

BACKGROUND OF THE INVENTION

1. Field of the Invention

The present invention generally relates to a cable connector assembly, and more particularly to a cable connector assembly having an additional pull tab for separating the cable connector assembly from a complementary connector more conveniently.

2. Description of Related Art

It is well known that a cable connector assembly comprises a cable end connector and a cable terminating to the cable end connector. The cable connector assembly electrically connects with a complementary connector to transmit signals from the cable to the complementary connector. The cable connector assembly and the complementary connector are often equipped with interlocking mechanisms to secure two mated connectors together.

U.S. Pat. Nos. 5,788,534 and 5,820,412 both issued to Koegel et al., each disclose a cable connector assembly having a pair of jackscrews assembled thereto. The jackscrew has an operating portion for being operated by a screw driver or by some other tools or by an operator's fingers, a threaded portion for engaging with a mating connector and a medial portion interconnecting the operating portion with the threaded portion. The cable connector assembly comprises a contact module terminating an electrical cable and an upper and a lower covers enclosing the contact module. The lower cover defines a pair of first channels at two opposite lateral sides thereof. The upper cover defines a pair of second channels aligned with first channels. The pair of jackscrews is received in the first and the second channels in a manner that allows the rotation and movement of the jackscrews. When the cable connector assembly mates with the mating connector, the operating portion is operated to rotatably and movably actuate the threaded section to engage with a locking nut of the mating connector.

When the cable connector assembly is to be separated from the mating connector, the operator needs to loosen the screw-nut connection between the connectors by using the screw driver or the fingers of the operator. However, a panel of a chassis to which the mating connector is mounted may have so many components mounted thereon that the operator can only loosen the screw connection by using the screw driver. Then the operator has no choice but pull the electrical cable exposed out of the cable connector assembly for separating the cable connector assembly completely from the mating connector. The electrical cable usually comprises a plurality of wires each comprising at least one conductor. The conductors are respectively soldered with the contact module for establishing an electrical connection with the contact module to transmit signals. Under such condition, to completely separate the mated connectors, the pulling force must be bigger than a mating force therebetween. When such pulling force is exerted on the cable, the conductors stand a good chance of being divorced from the contact module. Thus, the signal transmission is adversely influenced.

U.S. Pat. No. 5,564,939, issued to Maitani et al., on Oct. 15, 1996, discloses a kind of latch spring used for a conventional cable connector assembly. The cable connector assembly comprises a pair of latch springs respectively attached on opposite sides of a housing of the assembly. An operating member has a pair of latch releasing cams located below angled portions of the latch springs. When an operator pulls a pull tab of the operating member backwardly, the latch releasing cams exert outward forces on the angled portions and U-shaped claws slip out to release a mated complementary connector. However, the structure of the latch springs is relatively complex, thus, the manufacturing cost thereof is relatively high. In addition, because the latch springs are positioned outside of the housing, they are easy to be damaged by a force exerted thereon.

Hence, a cable connector assembly with an improved pull tab for achieving a reliable transmission is needed to address the problems encountered in the related art.

SUMMARY OF THE INVENTION

An object of the present invention is to provide a cable connector assembly conveniently separating from a complementary connector.

Another object of the present invention is to provide a cable connector assembly having a simply structured pull tab.

In order to achieve the objects set forth, a cable connector assembly in accordance with the present invention comprises a cover, an insulative housing, a plurality of contacts retained in the insulative housing, a cable electrically connected with the contacts, and a pull tab. The cover comprises a first and a second covers joined together to define a front end and a rear end opposite to the front end. The rear end defines a receiving space therein. The insulative housing is situated at the front end of the cover. The pull tab is assembled to the rear end of the cover and comprises an engaging section received in the receiving space of the cover.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
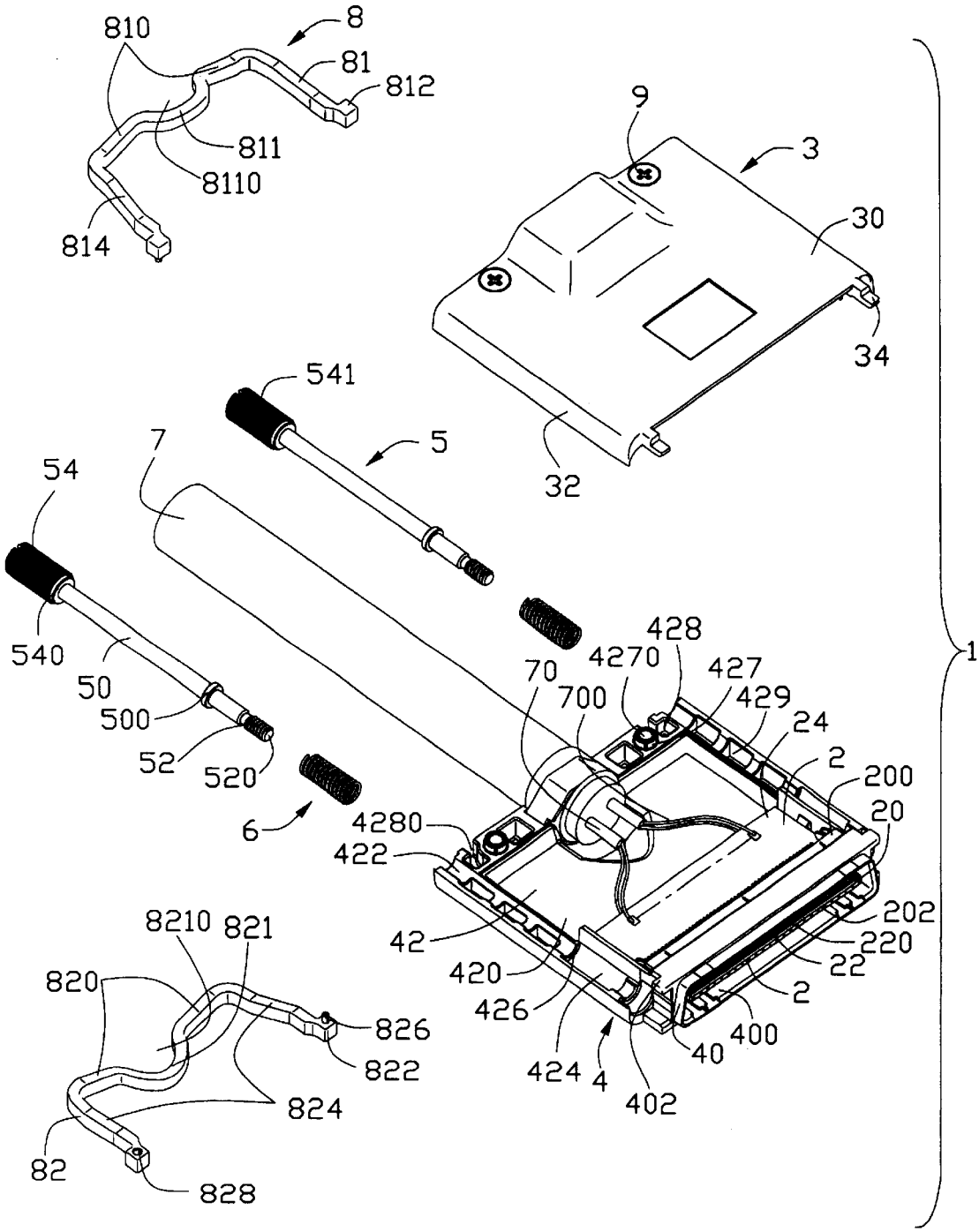
FIG. 1 is a partially exploded, perspective view of a cable connector assembly in accordance with the present invention.
Figure 2:
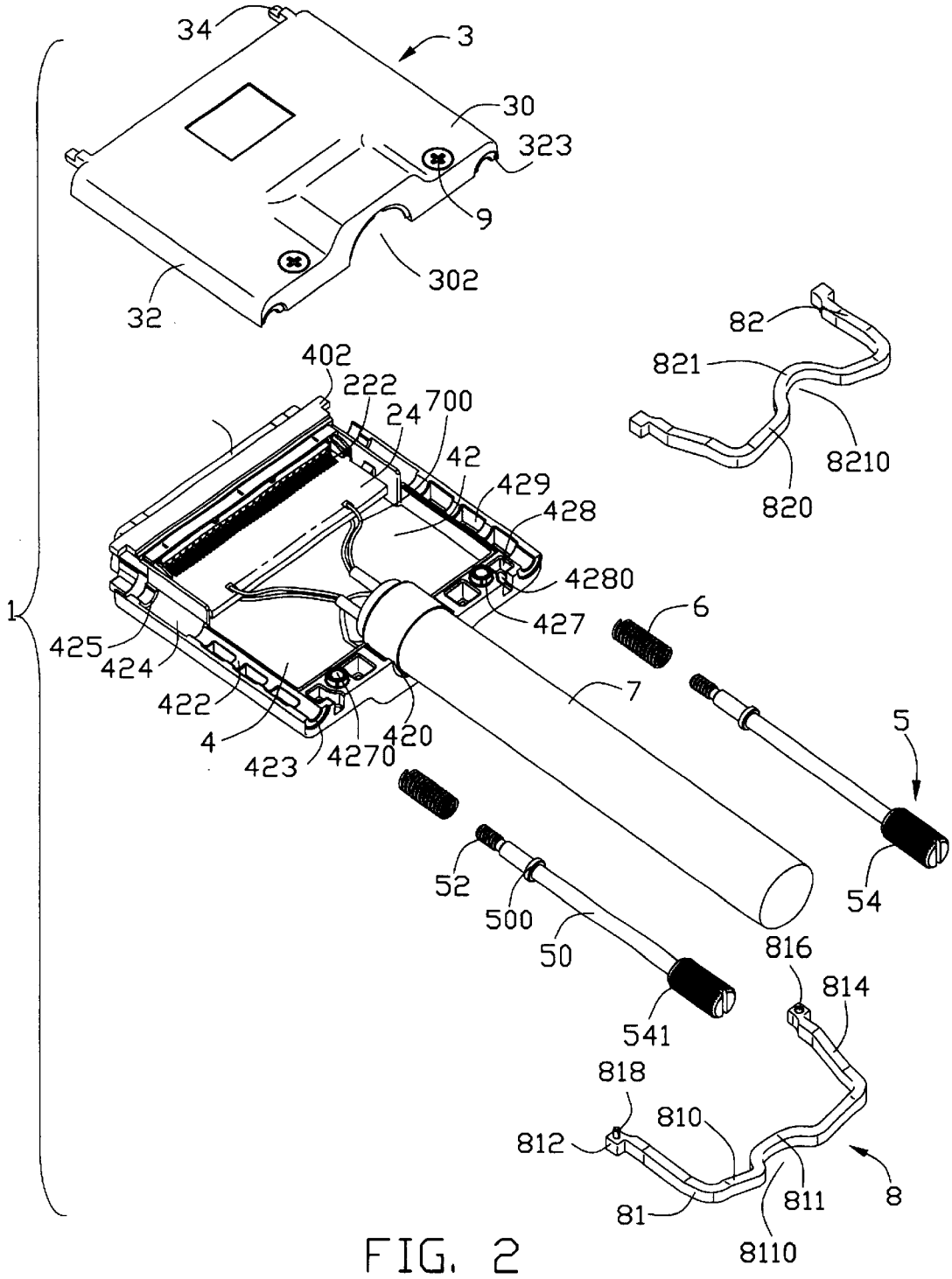
FIG. 2 is a view similar to FIG. 1, but taken from a rear aspect.

Referring to FIG. 1 and FIG. 2, a cable connector assembly 1 in accordance with the present invention comprises a contact module 2, an upper die cast cover 3, a lower die cast cover 4, a pair of fastening members 5, a pair of spring members 6, an electrical cable 7, a pair of pull tabs 8 and a pair of screws 9.

The contact module 2 comprises an insulative housing 20, a plurality of contacts 22 and a printed circuit board 24. The insulative housing 20 comprises a base portion 200, a tongue portion 202 extending forwardly from the base portion 200 and a plurality of passageways (not labeled) extending from the tongue portion 202 through the base portion 200.

The contacts 22 are received in the passageways of the insulative housing 20. Each contact 22 comprises a contacting portion 220 retained in the tongue portion 202 for contacting with a complementary connector (not shown) and a connecting portion 222 extending in a direction opposite to the contacting portion 220 beyond a rear face of the base portion 200.

The printed circuit board 24 is assembled to the base portion 200 of the insulative housing 20 and is straddled by and electrically connected with the connecting portions 222 of the contacts 22 at a front end thereof.

Figure 3:
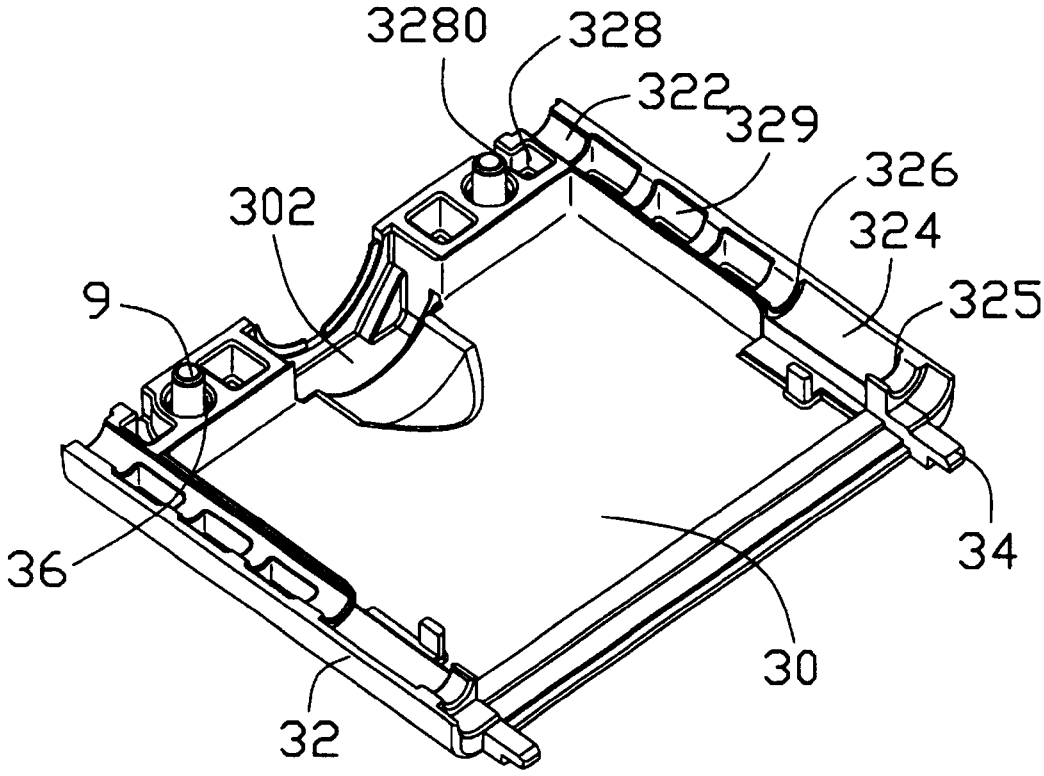
FIG. 3 is a perspective view of an upper cover of the cable connector assembly.

In conjunction with FIG. 3, the upper cover 3 comprises a generally planar body portion 30, a pair of flanges 32 extending downwardly from opposite lateral sides of the body portion 30 and a pair of spaced fingers 34 extending forwardly from a front end of the body portion 30. The body portion 30 defines a first substantially semicircular opening 302 at a rear end thereof. A pair of first receiving holes 328 is defined in a rear end of the body portion 30 and spaced by the opening 302. A first guiding recess 3280 communicates the first receiving hole 328 with a rear face of the body portion 30. Each flange 32 defines a first channel 322 extending through a whole length thereof and a first depression 323 (see FIG. 2) at the rear end thereof in communication with the first channel 322. The first channel 322 comprises a first recessed section 324 adjacent to a front portion thereof. The first recessed section 324 recesses more deeply and widely than other portions of the first channel 322 and defines a front end 325 and an opposite rear end 326 respectively connecting with front and rear portions of the first channel 322. A pair of first screw holes 36 is defined adjacent corresponding first receiving holes 328. The flanges 32 define a plurality of cutouts 329 therein to reduce the weight of the upper cover 3.

Referring to FIG. 1 and FIG. 2, the lower cover 4 comprises a mating frame 40 defining a cavity 400 therein and a cover body 42 extending rearwardly from the mating frame 40. The mating frame 40 has a pair of engaging ears 402 extending laterally outwardly from a top portion thereof. The cover body 42 defines a space 420 in communication with the cavity 400, a pair of second channels 422 at opposites lateral sides thereof and a pair of second depressions 423 at a rear end thereof respectively in communication with the second channels 422. The second channels 422 extend through a whole length of the cover body 42. Each second channel 422 comprises a second recessed section 424 corresponding to the first recessed section 324 of the first channel 322. The second recessed section 424 recesses more deeply and widely than other portions of the second channel 322 and defines a front end 425 and an opposite rear end 426 respectively connecting with front and rear portions of the second channel 422. A pair of posts 427 protrudes upwardly adjacent to the rear end of the cover body 42 with a second screw hole 4270 defines therein. A pair of second receiving holes 428 is defined adjacent to corresponding posts 427. A second guiding recess 4280 communicates the second receiving hole 428 with a rear face of the cover body 42. The cover body 42 also defines a plurality of cutouts 429 to reduce the weight of the lower cover 4 and a second substantially semicircular opening 420 at the rear end thereof.

Each of the fastening member 5 is generally cylindrical and is sometimes called jackscrew by some people. The fastening member 5 comprises an elongated medial portion 50, a threaded portion 52 extending forwardly form the medial portion 50 and an operating portion 54 extending rearwardly from the medial portion 50. The medial portion 50 is formed with an annular stop section 500 protruding outwardly from a circumferential periphery thereof. The operating portion 54 has a contacting section 540 adjacent to the medial portion 50. An outer surface 541 of the operating portion 54 is slotted for increasing a friction between fingers of a user and the operating portion 54 when the user grabs the operating portion 54.

The pull tabs 8 are made of soft material such as nylon 66 and comprises a first pull tab 81 and a second pull tab 82. Each of the first and the second pull tabs 81, 82 is of a substantially M-shape configuration and comprise a pulling section and an engaging section. The pulling section comprises a pair of transverse bars 810, 820. A medial section 811, 821 joins opposite inner ends of the pair of transverse bars 810, 820. A pair of arms 814, 824 substantially perpendicularly extends forwardly from opposite outmost ends of the transverse bars 810, 820. The medial section 811, 821 extends forwardly from the inner ends of the pair of transverse bars 810, 820 to form a space 8110, 8210. The engaging section comprises a pair of rectangular tip ends 812, 822 integrally extending from ends (not labeled) of respective arms 814, 824 and away from each other. A first hole 816 and a first post 818 are respectively formed on the tip ends 812 of the first pull tab 81. A second post 826 and a second hole 828 are respectively formed on the tip ends 822 of the second pull tab 82 corresponding to the first hole 816 and the first post 818.

The cable 7 comprises a plurality of wires 70 therein. Each wire 70 has at least one conductor 700 electrically connecting with a rear end of the printed circuit board 24.

Figure 4:
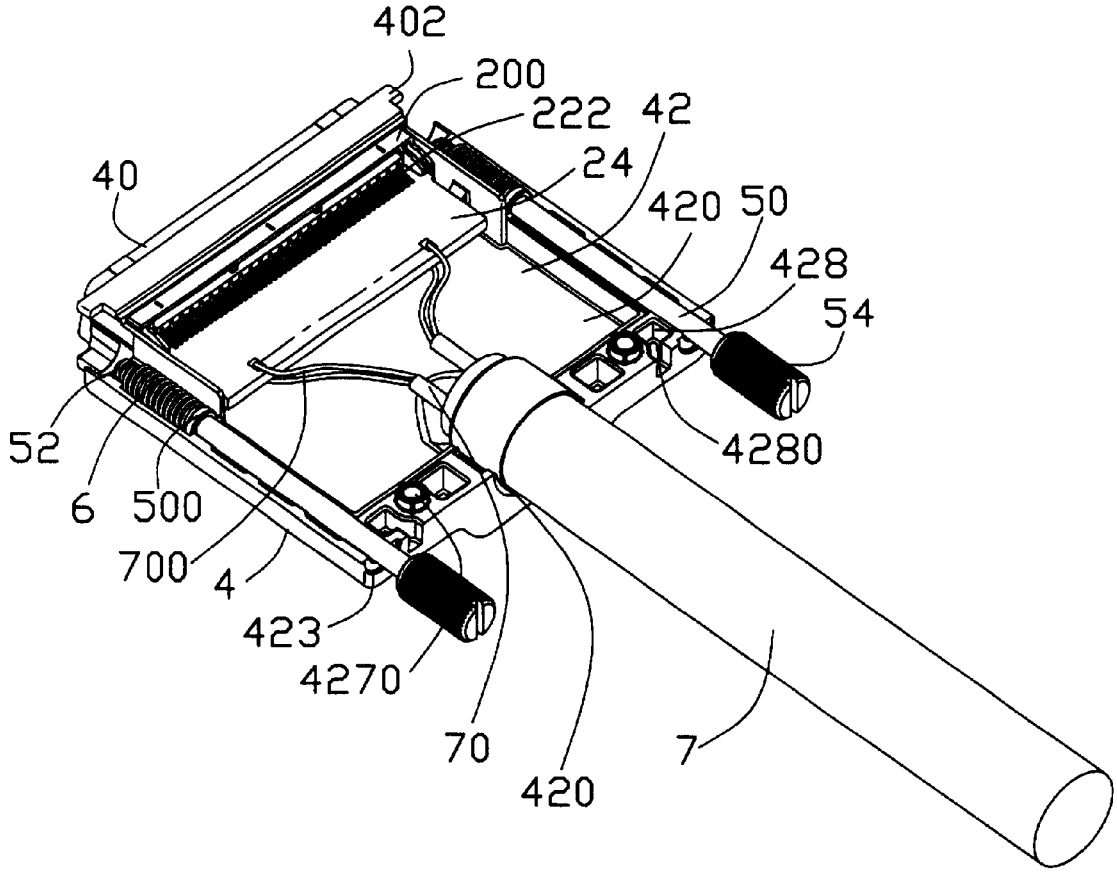
FIG. 4 is a partially assembled perspective view of FIG. 2, without the upper cover and a pair of pull tabs to clearly show a pair of jackscrews thereof.

Referring to FIG. 4, in assembly, the contact module 2 is assembled in the lower cover 4 with the tongue portion 202 having the contacting portions 220 thereon being accommodated in the cavity 400 of the mating frame 40 and the printed circuit board 24 extending into the space 420. A front end of the cable 7 is received in the second hole 420 with the conductors 700 electrically connecting with the rear end of the printed circuit board 24.

The fastening members 5 are disposed in the second channels 422 of the lower cover 4 with the stop sections 500 being located in the second recessed sections 424 adjacent to the second ends 426 (referring to FIG. 1) of the recessed sections 424.

Each of the spring members 6 is disposed on a corresponding fastening member 5. When the fastening member 5 is disposed in the second channel 422, the spring member 6 is received in a corresponding second recessed section 424 with one end abutting against the stop section 500 of the fastening member 5 and the other end abutting against the front end 425 of the second recessed section 424.

Figure 5:
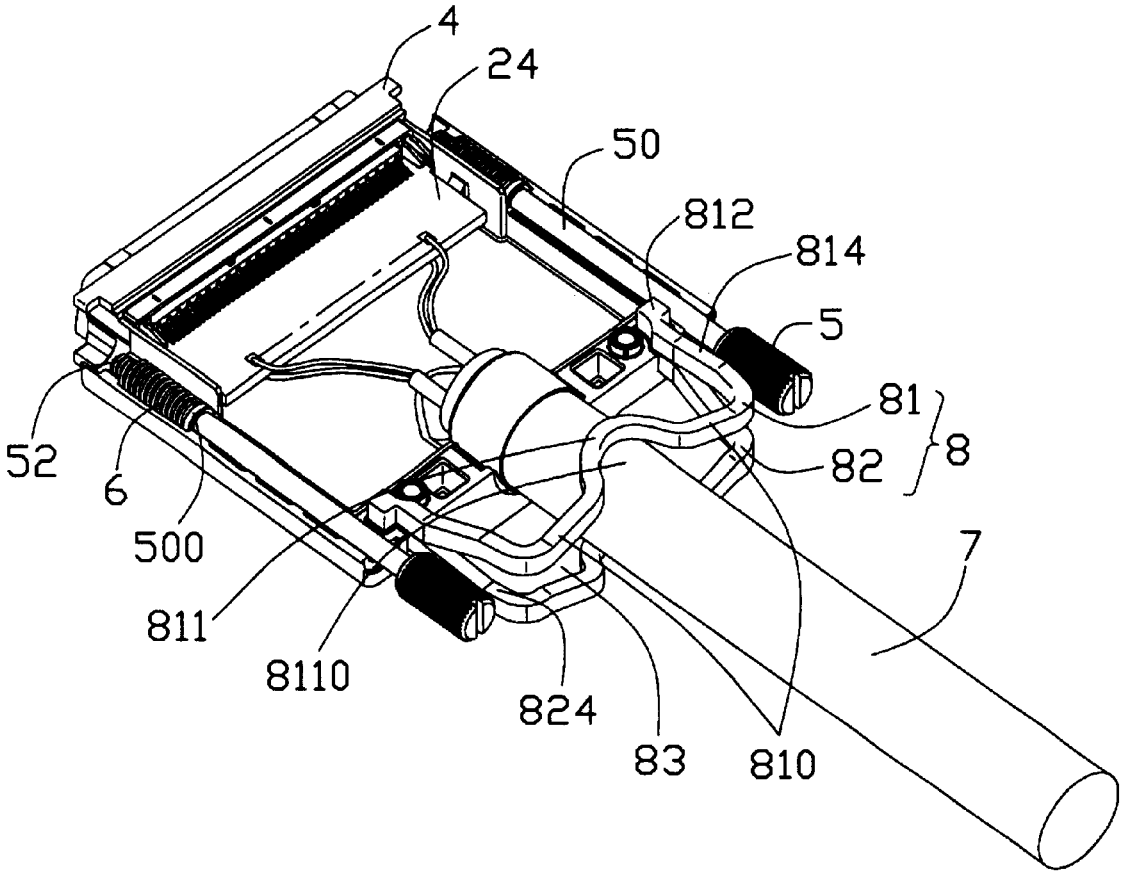
FIG. 5 is a partially assembled perspective view of the cable connector assembly of FIG. 2, without the upper cover to clearly show the pair of pull tabs.
Figure 6:
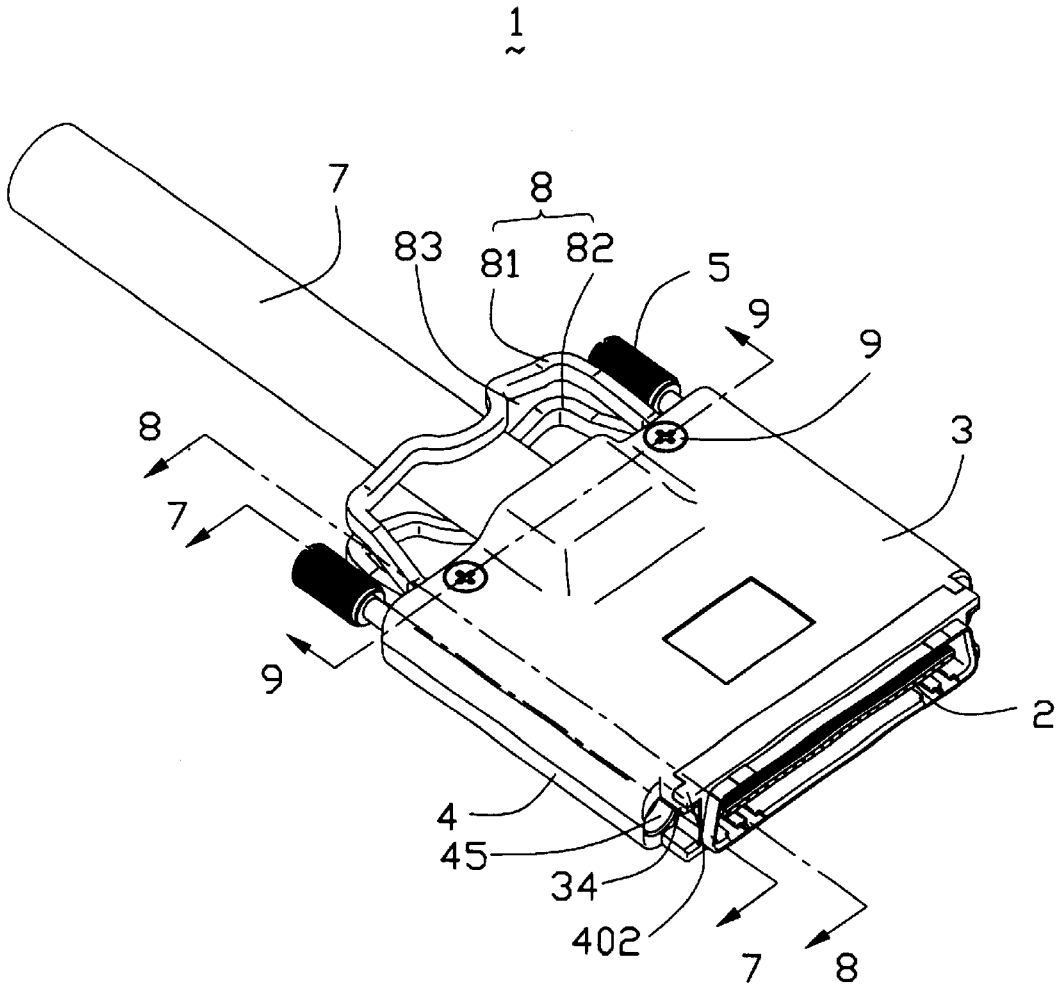
FIG. 6 is an assembled perspective view of the cable connector assembly of FIG. 1.
Figure 7:
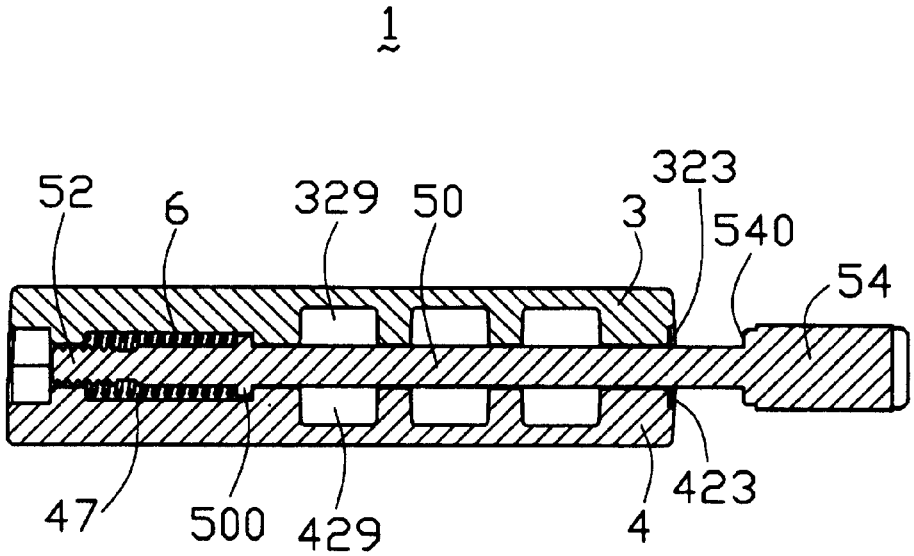
FIG. 7 is a cross-sectional view of the cable connector assembly taken along line 7—7 of FIG. 6.
Figure 8:
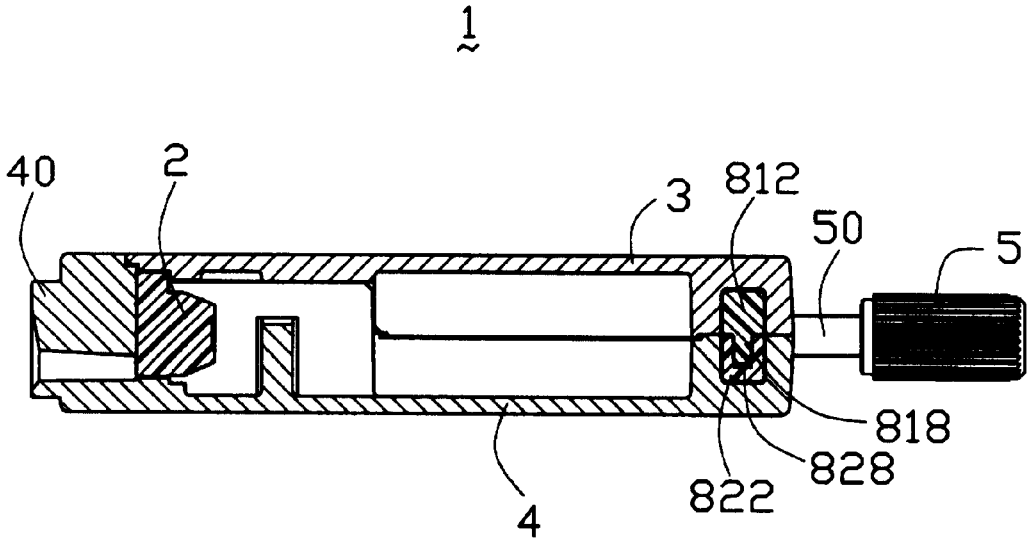
FIG. 8 is a cross-sectional view of the cable connector assembly taken along line 8—8 of FIG. 6.
Figure 9:
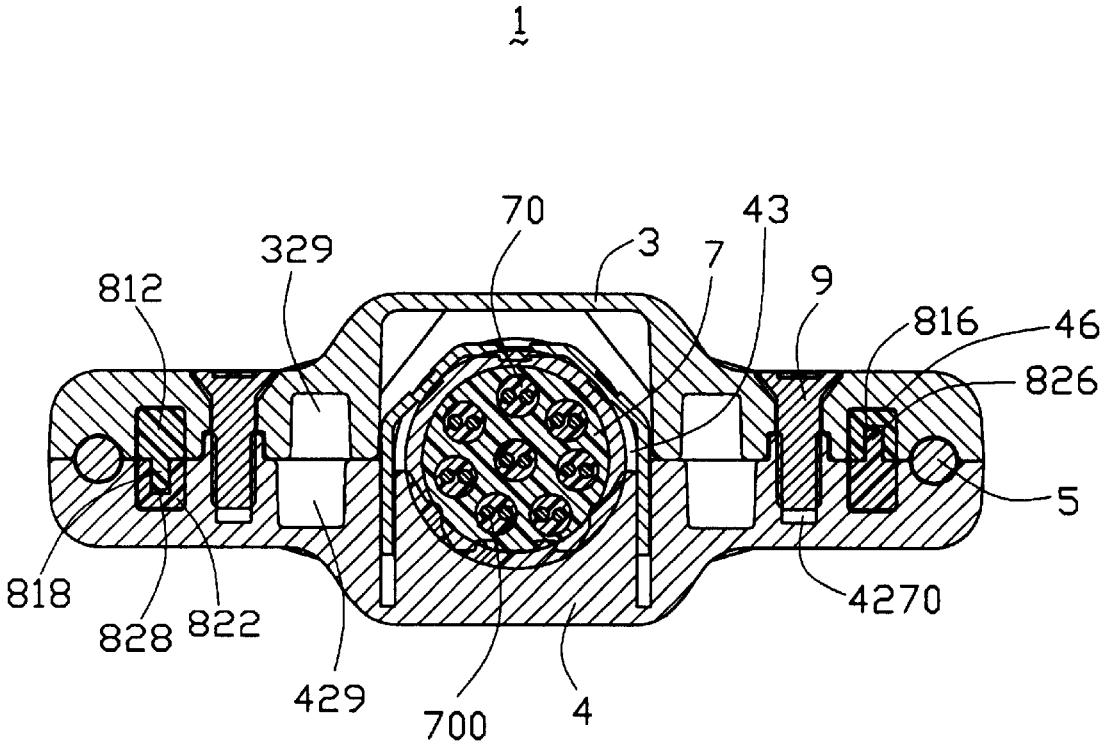
FIG. 9 is a cross-sectional view of the cable connector assembly taken along line 9—9 of FIG. 6.

Referring to FIG. 5 in conjunction with FIGS. 1 and 2, the pull tabs 8 are assembled to the lower cover 4 and spaced by the cable 7. Thus, the spaced first and the second pull tabs 81, 82 form a lateral space 83 therebetween. The tip ends 822 of the second pull tab 8 are firstly received in the second receiving holes 428 with the ends of the arms 824 being received in the guiding recesses 4280 for preventing the second pull tab 82 from separating from the lower cover 4. The first pull tab 81 is mounted to the second pull tab 82 with the first post 818 being received in the second hole 828 and the second post 826 being received in the first hole 816.

Referring to FIGS. 6–9, the upper cover 3 is assembled to the lower cover 4 with the fingers 34 partially extending below the engaging ears 402 to engage with the engaging ears 402. The posts 427 of the lower cover 4 are received in the first screw holes 36 with the screws 9 screwing into the second screw holes 4270 to securely fasten the upper and the lower covers 3, 4 together. The cable 7 is received in the cable exit 43 formed by the first and the second openings 302, 420. The fastening members 5 are movably and rotatably received in first passages 45 formed by the first and the second channels 322, 422. The stop sections 500 and the spring members 6 are movably accommodated in second passages 47 (FIG. 7) formed by the first and the second recessed sections 324, 424. The tip ends 812 of the first pull tab 81 are respectively received in the first receiving holes 328 with the ends of the arms 814 being received in the first guiding recesses 3280. Thus, the engaging sections 812, 822, which engage with each other, are together received in a corresponding receiving space 46 formed by the first and the second receiving holes 328, 428. In such a way, the cable connector assembly 1 is assembled together.

Further referring to FIGS. 6–9, in use, when the cable connector assembly 1 is to be locked with the complementary connector, the operating portions 54 of the fastening members 5 are accessed by the user to push the fastening members 5 forwardly. The stop sections 500 move forwardly from the rear ends 326, 426 of the recessed sections 324, 424 until the contacting sections 540 of the operating portions 54 are received in the depressions 323, 423 of the upper and the lower covers 3, 4. Due to the forward movement of the stop sections 500, the spring members 6 are compressed to be snugly located between the stop sections 500 and the front ends 325, 425 of the recessed sections 324, 424. The threaded portions 52 are rotated by rotating the operating portions 54 to thus engage with locking nuts of the complementary connector, whereby a lock is established between the cable connector assembly 1 and the complementary connector. In addition, Due to the existence of the space 8110, 8210 and the lateral space 83, the cable 7 can move upwardly, downwardly and laterally without being blocked. Thus, the cable connector assembly 1 can be used in different circumstances.

When the cable connector assembly 1 is to be unlocked from the complementary connector, the user only needs to rotate the operating portions 54 reversely by using the fingers or by a screw driver. The spring member 6 automatically resumes to its original shape to motivate the fastening member 5 to move rearwardly until the stop section 500 abuts against the rear ends 326, 426 of the recessed sections 324, 424. Then the user can drag the pull tabs 8 rearwardly to separate the cable connector assembly 1 completely from the complementary connector. The resuming force of the spring members 6 exerting on the fastening members 5 causes the fastening members 5 completely separate from the locking nuts of the complementary connector. The separating force exerted on the pull tab 8 is merely a mating force between the cable connector assembly 1 and the complimentary connector, thereby decreasing the possibility of damaging the pull tab 8.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector assembly, comprising:

a cover comprising a first and a second cover-halves joined together, a front end and a rear end opposite to the front end, the rear end defining a receiving space therein;

an insulative housing situated at the front end of the cover;

a plurality of contacts retained in the insulative housing;

a cable electrically connected with the contacts; and a first pull tab assembled to the rear end of the cover and comprising a first engaging section received in the receiving space of the cover, further comprising a second pull tab comprising a second engaging section engaging with the first engaging section and received in the receiving space; wherein each of the first and the second pull tabs comprises a pulling section and a pair of arms extending from the pulling section, and wherein each of the first and the second engaging sections comprises a pair of tip ends extending integrally from respective arms and away from each other; wherein the pulling section of each of the first and the second pull tabs comprises a pair of transverse bars, and wherein a medial section joins the pair of transverse bars and extends substantially vertically and forwardly from the transverse bars; wherein the receiving space of the cover comprises a pair of first receiving holes defined in the first cover and a pair of second receiving holes defined in the second cover, and wherein the first and the second tip ends are respectively received in the first and the second receiving holes; wherein one first tip end forms a first post thereon and the other first tip end defines a first hole therein, one second tip end defines a second hole therein and the other second tip end forms a second post thereon, and wherein the first and second posts are respectively received in the second and the first holes, further comprising a pair of fastening members, and wherein the first and the second cover together define a pair of first passages receiving the fastening members and a pair of second passages recessing from corresponding passages; wherein each fastening member comprises a medial portion received in a corresponding first passage, a threaded portion extending from the medial portion, and an operating portion extending from the medial portion opposite to the threaded portion and exposed outside the first passage, and wherein the medial portion comprises a stop section movably received in the second passages; wherein each first passage comprises a first channel defined in the first cover and a second channel defined in the second cover, and wherein each second passage comprises a first recessed section recessed from the first channel and a second recessed section recessed from the second channel, further comprising a spring member disposed on one fastening member and received in one corresponding second passage of the cover, and wherein the second passage of the cover defines a first end adjacent to the threaded portion and a second end opposite to the first end, the spring member is disposed between the stop section and the first end of the second passage.

2. The cable connector assembly as claimed in claim 1, wherein the first engaging section of the first pull tab forms a first post thereon, and wherein the second engaging section of the second pull tab defines a second hole to receive the first post.

3. The cable connector assembly as claimed in claim 1, wherein the first and the second covers are die cast covers, the first and the second covers define a plurality of cutouts to reduce weight thereof.

* * * * *